US006696393B1

(12) United States Patent
Boffa

(10) Patent No.: US 6,696,393 B1
(45) Date of Patent: Feb. 24, 2004

(54) METHODS AND COMPOSITIONS FOR REDUCING WEAR IN INTERNAL COMBUSTION ENGINES LUBRICATED WITH A LOW PHOSPHORUS CONTENT LUBRICATING OIL

(75) Inventor: Alexander B. Boffa, Richmond, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 10/212,027

(22) Filed: Aug. 1, 2002

(51) Int. Cl.[7] ..... C10M 141/10; C10M 141/12

(52) U.S. Cl. ..... 508/287; 508/291; 508/232; 508/375; 508/376; 508/377

(58) Field of Search ..... 508/291, 232, 508/287, 375, 376, 377

(56) References Cited

U.S. PATENT DOCUMENTS

| | | | | | |
|---|---|---|---|---|---|
| 4,176,074 | A | * | 11/1979 | Coupland et al. | 508/191 |
| 4,259,194 | A | | 3/1981 | deVries et al. | |
| 4,259,195 | A | | 3/1981 | King et al. | |
| 4,261,843 | A | | 4/1981 | King et al. | |
| 4,263,152 | A | | 4/1981 | King et al. | |
| 4,265,773 | A | | 5/1981 | deVries et al. | |
| 4,272,387 | A | | 6/1981 | King et al. | |
| 4,283,295 | A | | 8/1981 | deVries et al. | |
| 4,285,822 | A | | 8/1981 | deVries et al. | |
| 4,315,826 | A | | 2/1982 | Schlicht et al. | |
| 4,324,672 | A | * | 4/1982 | Levine et al. | 508/230 |
| 4,369,119 | A | | 1/1983 | deVries et al. | |
| 4,395,343 | A | | 7/1983 | deVries et al. | |
| 4,402,840 | A | * | 9/1983 | deVries et al. | 508/362 |
| 4,455,243 | A | * | 6/1984 | Liston | 508/192 |
| 4,495,075 | A | | 1/1985 | Buckley | |
| 4,975,096 | A | | 12/1990 | Buckley, III | |
| 5,569,405 | A | | 10/1996 | Nakazato et al. | |
| 5,629,272 | A | | 5/1997 | Nakazato et al. | |
| 5,672,572 | A | | 9/1997 | Arai et al. | |
| 5,814,587 | A | | 9/1998 | Vrahopoulou et al. | |
| 6,074,993 | A | * | 6/2000 | Waddoups et al. | 508/364 |
| 6,300,291 | B1 | * | 10/2001 | Hartley et al. | 508/363 |
| 6,323,162 | B1 | | 11/2001 | Yasunori et al. | |
| 6,358,894 | B1 | | 3/2002 | Leta et al. | |
| 6,369,005 | B1 | | 4/2002 | Karol et al. | |
| 6,423,671 | B1 | | 7/2002 | Haruna | |
| 6,500,786 | B1 | * | 12/2002 | Hartley et al. | 508/365 |
| 6,562,765 | B1 | | 5/2003 | Boffa | |
| 2002/0098990 | A1 | | 7/2002 | Nakazato et al. | |
| 2002/0107152 | A1 | | 8/2002 | Robson | |

FOREIGN PATENT DOCUMENTS

| | | | |
|---|---|---|---|
| GB | 2.037317 | * | 7/1980 |

OTHER PUBLICATIONS

D.D. Beck, J.W. Sommers, C.L. DiMaggio and D.R. Monroe, "Impact of Oil–Derived Catalyst Poisons on FTP Performance of LEV Catalyst Systems"; SAE Technical Paper Series 972842; pp. 1–10, Oct., 1997.

S.T. Darr, R.A. Choksi, C.P. Hubbard, M.D. Johnson and R.W. McCabe, Ford Motor Company; "Effects of Oil–Derived Contaminants on Emissions from TWC–Equipped Vehicles", SAE Technical Paper Series 2000–01–1881, pp. 1–9, Jun., 2000.

* cited by examiner

*Primary Examiner*—Jacqueline V. Howard
(74) *Attorney, Agent, or Firm*—Joseph P. Foley; Claude J. Caroli

(57) ABSTRACT

Disclosed are methods and lubricant compositions for reducing wear in internal combustion engines lubricated with a low phosphorus content lubricating oil. The lubricant compositions of this invention comprise a synergistic combination of a complex of a molybdenum/nitrogen containing compound and at least one phosphorus-containing compound wherein the total phosphorus employed in the composition is no more than about 0.06 weight percent based on the total weight of the composition.

22 Claims, No Drawings

METHODS AND COMPOSITIONS FOR REDUCING WEAR IN INTERNAL COMBUSTION ENGINES LUBRICATED WITH A LOW PHOSPHORUS CONTENT LUBRICATING OIL

FIELD OF THE INVENTION

This invention is directed, in part, to lubricant compositions for reducing wear in internal combustion engines lubricated with a low phosphorus content lubricating oil, and to methods employing such. The lubricant compositions of this invention comprise a synergistic combination of a complex of a molybdenum/nitrogen containing compound and at least one oil-soluble, phosphorus-containing, anti-wear compound wherein the total phosphorus employed in the composition is no more than about 0.06 weight percent based on the total weight of the composition.

REFERENCES

The following references are cited in this application as superscript numbers:

[1] Buckley, III, Long Chain Aliphatic Hydrocarbyl Amine Additives Having an Oxyalkylene Hydroxy Connecting Group, U.S. Pat. No. 4,975,096, issued Dec. 4, 1990

[2] Buckley, Methods and Compositions for Preventing the Precipitation of Zinc Dialkyldithiophosphates Which Contain High Percentages of a Lower Alkyl Group, U.S. Pat. No. 4,495,075, issued Jan. 22, 1985

[3] Beck, et al., Impact of Oil-Derived Catalyst Poisons on FTP Performance of LEV Catalyst Systems, SAE Technical Paper 972842 (1997)

[4] Johnson, et al., Effects of Oil-Derived Contaminants on Emissions from TWC-Equipped Vehicles, SAE 200-01-1881 (2000)

All of the above references are herein incorporated by reference in their entirety to the same extent as if each individual reference was specifically and individually indicated to be incorporated by reference in its entirety.

STATE OF THE ART

Emissions arising from automotive exhaust has been a problem for several decades and approaches for addressing this problem have included the use of unleaded fuel (to deal, in part, with lead pollution arising from leaded fuels), oxygenated fuel (to reduce hydrocarbon emissions), the use of catalytic converters (also to reduce hydrocarbon emissions), etc.

Catalytic converters are now universally employed with gasoline powered vehicles and the efficiency of these converters is directly related to the ability of the catalyst to effect conversion of unburnt or partially burnt hydrocarbons generated during combustion to carbon dioxide and water. One problem arising with the use of such converters is poisoning of the catalyst resulting in reduced catalyst efficiency. Since catalytic converters are intended for extended use, catalyst poisoning results in higher levels of atmospheric discharges of pollutants from internal combustion engines over prolonged periods of time.

In order to minimize such poisoning, the industry has set standards for both fuel and lubricant contents. For example, standards for fuels have included the use of unleaded gasoline in order to avoid lead poisoning of the catalyst[1] as well as lead discharge into the environment.

As to the lubricants, one additive family currently being addressed by industry standards is the phosphorus-containing additives used in lubricant compositions employed to lubricate internal combustion engines. Specifically, phosphorus-containing additives reach the catalytic converter as a result of, for example, exhaust gas recirculation and/or oil blow-by processes as well as other methods known in the art. See, for example, Beck, et al. and Johnson, et al.[3,4] In any event, the phosphorus is known to accumulate in the catalytic converter, at active metal sites; thus reducing catalyst efficiency and effectively over time, poisoning the catalyst. As a result of the above, a new focus is to lower phosphorus in the lubricating oils. For example, the draft GF-4 specifications for lubricant compositions have proposed significantly lower phosphorus contents than heretofore employed.

A problem arises when the level of phosphorus is reduced in a lubricant composition containing an oil-soluble, phosphorus-containing, anti-wear compound in that there is a significant reduction in anti-wear performance arising from this diminution in phosphorus content. One well known class of antiwear additives are metal alkylphosphates, especially zinc dialkyl dithiophosphates are generally employed in lubricating oils at phosphorous levels above 0.1 weight percent when used for wear control. At lower levels, it is not found to be an effective antiwear additive. For instance, as exemplified herein, lowering the level of phosphorus due to the presence of a metal dithiophosphate additive in a lubricant composition by one-half from 0.095 weight percent to 0.048 weight percent phosphorus results in about a seven-fold increase in engine wear.

This invention is directed to the discovery that lubricant compositions comprising a combination of a complex of a molybdenum/nitrogen-containing compound and low levels of one or more oil-soluble, phosphorus-containing, anti-wear compounds synergistically reduce wear levels when used to lubricate gasoline engines.

With regard to the above, both metal dihydrocarbyl dithiophosphates, also referred to herein as metal dithiophosphates, and molybdenum/nitrogen containing complexes, including the preferred molybdenum succinimide complexes are well known in the art. In addition, lubricant compositions comprising combinations of alkyl or alkenyl succinimides and zinc dialkyl dithiophosphate are disclosed, for example, by Buckley.[2] Still further, lubricant compositions comprising both molybdenum succinimide and zinc dialkyl dithiophosphate and having a total phosphorus content of at least 0.07 weight percent based on the total weight of the composition have been hereto commercialized.

SUMMARY OF THE INVENTION

As noted above, this invention is directed, in part, to lubricant compositions comprising a combination of a complex of a molybdenum/nitrogen-containing compound and at least one oil-soluble, phosphorus-containing anti-wear compound wherein the total phosphorus employed in the composition is no more than about 0.06 weight percent based on the total weight of the composition. This combination of additives synergistically reduces wear levels when used in lubricant compositions to lubricate internal combustion engines.

Accordingly, in one of its composition aspects, this invention is directed to a lubricating oil composition comprising a major amount of an oil of lubricating viscosity, at least one oil-soluble, phosphorus-containing, anti-wear compound wherein the weight percent of total phosphorus in the composition is no more than about 0.06 weight percent based on the total weight of the composition; and an anti-wear effective amount of a complex of a molybdenum/nitrogen containing compound.

In a preferred embodiment, the total phosphorus in the composition is no more than 0.05 weight percent based on the total weight of the composition.

Preferably, the oil-soluble, phosphorus-containing, anti-wear compound is selected from the group consisting of metal dithiophosphates, phosphorus esters (including phosphates, phosphonates, phosphinates, phosphine oxides, phosphites, phosphonites, phosphinites, phosphines and the like), amine phosphates and amine phosphinates, sulfur-containing phosphorus esters including phosphoro monothionate and phosphoro dithionates, phosphoramides, phosphonamides and the like. More preferably, the phosphorus-containing compound is a metal dithiophosphate and, even more preferably, a zinc dithiophosphate.

The complex of a molybdenum/nitrogen-containing compound is preferably a molybdenum succinimide. The complex includes both sulfurized and non-sulfurized forms and, preferably, the complex is sulfurized.

A particularly preferred complex of a molybdenum/nitrogen containing compound is disclosed in commonly assigned U.S. Ser. No. 10/159,446 filed on May 31, 2002 as and entitled "Reduced Color Molybdenum-Containing Composition and a Method of Making Same" which application is incorporated herein by reference in its entirety.

In one of its method aspects, this invention is directed to a method for controlling wear during operation of an internal combustion engine, which method comprises operating the engine with a lubricant composition comprising a major amount of an oil of lubricating viscosity, at least one oil-soluble, phosphorus-containing, anti-wear compound wherein the weight percent of total phosphorus in the composition is no more than about 0.06 weight percent based on the total weight of the composition, and an anti-wear effective amount of a molybdenum/nitrogen-containing compound.

DETAILED DESCRIPTION OF THE INVENTION

This invention is directed, in part, to novel lubricant compositions comprising a combination of a molybdenum/nitrogen-containing compound and at least one phosphorus-containing compound wherein the total phosphorus employed in the composition is no more than about 0.06 weight percent based on the total weight of the composition.

Each of these components in the claimed composition will be described in detail herein. However, prior to such a description, the following terms will first be defined.

The term "an oil-soluble, phosphorus-containing, anti-wear compound" refers to additives in lubricant compositions that contain phosphorus and which exhibit an anti-wear benefit, either alone or when used in combination with other additives, during operation of an internal combustion engine that is lubricated with such a lubricant composition. The phosphorus in such additives is typically integral to the additive function.

The term "total phosphorus" refers to the total amount of phosphorus in the lubricant composition regardless of whether such phosphorus is present as part of an oil-soluble, phosphorus-containing, anti-wear compound or in the form of a contaminant in the lubricant composition such as residual phosphorus remaining due to the presence of $P_2S_5$ used to prepare metal dihydrocarbyl dithiophosphates. In either event, the amount of phosphorus permitted in the lubricant composition is independent of source. Preferably, however, the phosphorus is part of a lubricant additive.

THE MOLYBDENUM/NITROGEN-CONTAINING COMPLEXES

The molybdenum/nitrogen-containing complexes (additives) employed in the compositions and methods of this invention are well known in the art and are complexes of molybdic acid and an oil-soluble basic nitrogen-containing compound. Such additives have been used as lubricating oil additives to control oxidation and wear of engine components. Since their discovery, such complexes have been widely used as engine lubricating oil additives in automotive crankcase oils.

The molybdenum/nitrogen-containing complex is normally made with an organic solvent comprising a polar promoter during a complexation step and procedures for preparing such complexes are described, for example, in U.S. Pat. Nos. 4,402,840; 4,394,279; 4,370,246; 4,369,119; 4,285,822; 4,283,295; 4,265,773; 4,263,152; 4,261,843; 4,259,1951 and 4,259,194 all of which are incorporated herein by reference in their entirety. As shown in these references, the molybdenum/nitrogen-containing complex can further be sulfurized.

The polar promoter used in the preparation of the molybdenum or molybdenum/sulfur compositions of this invention is one that facilitates the interaction between the molybdenum compound and the basic nitrogen compound. A wide variety of such promoters are well known to those skilled in the art. Typical promoters are 1,3-propanediol, 1,4-butanediol, diethylene glycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water.

While ordinarily the polar promoter is separately added to the reaction mixture, it may also be present, particularly in the case of water, as a component of non-anhydrous starting materials or as waters of hydration in the acidic molybdenum compound, such as $(NH_4)_6Mo_7O_{24}.4H_2O$. Water may also be added as ammonium hydroxide.

The complexation step can be followed by a sulfurization step as disclosed in King et al., U.S. Pat. No. 4,263,152, which is herein incorporated by reference. Related King et al., U.S. Pat. No. 4,272,387, is also incorporated by reference.

Representative sulfur sources for preparing the sulfurized complexes described herein are sulfur, hydrogen sulfide, sulfur monochloride, sulfur dichloride, phosphorus pentasulfide, $R_2S_x$ where R is hydrocarbyl, preferably $C_{1-40}$ alkyl, and x is at least 2, inorganic sulfides and polysulfides such as $(NH_4)_2S_x$, where x is at least 1, thioacetamide, thiourea, and mercaptans of the formula RSH where R is as defined above. Also useful as sulfurizing agents are traditional sulfur-containing antioxidants such as wax sulfides and polysulfides, sulfurized olefins, sulfurized carboxylic and esters and sulfurized ester-olefins, and sulfurized alkylphenols and the metal salts thereof.

The sulfurized fatty acid esters are prepared by reacting sulfur, sulfur monochloride, and/or sulfur dichloride with an unsaturated fatty ester under elevated temperatures. Typical esters include $C_1$–$C_{20}$ alkyl esters of $C_8$–$C_{24}$ unsaturated fatty acids, such as palmitoleic, oleic, ricinoleic, petroselinic, vaccenic, linoleic, linolenic, oleostearic, licanic, paranaric, tariric, gadoleic, arachidonic, cetoleic, etc. Particularly good results have been obtained with mixed unsaturated fatty acid esters, such as are obtained from animal fats and vegetable oils, such as tall oil, linseed oil, olive oil, castor oil, peanut oil, rape oil, fish oil, sperm oil, and so forth.

Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

Cross-sulfurized ester olefins, such as a sulfurized mixture of $C_{10}$–$C_{25}$ olefins with fatty acid esters of $C_{10}$–$C_{25}$ fatty acids and $C_1$–$C_{25}$ alkyl or alkenyl alcohols, wherein the fatty acid and/or the alcohol is unsaturated may also be used.

Sulfurized olefins are prepared by the reaction of the $C_3$–$C_6$ olefin or a low-molecular-weight polyolefin derived therefrom with a sulfur-containing compound such as sulfur, sulfur monochloride, and/or sulfur dichloride.

Also useful are the aromatic and alkyl sulfides, such as dibenzyl sulfide, dixylyl sulfide, dicetyl sulfide, diparaffin wax sulfide and polysulfide, cracked wax-olefin sulfides and so forth. They can be prepared by treating the starting material, e.g., olefinically unsaturated compounds, with sulfur, sulfur monochloride, and sulfur dichloride. Particularly preferred are the paraffin wax thiomers described in U.S. Pat. No. 2,346,156.

Sulfurized alkyl phenols and the metal salts thereof include compounds such as sulfirized dodecylphenol and the calcium salts thereof. The alkyl group ordinarily contains from 9–300 carbon atoms. The metal salt may be preferably, a Group I or Group II salt, especially sodium, calcium, magnesium, or barium.

Preferred sulfur sources are sulfur, hydrogen sulfide, phosphorus pentasulfide, $R_2S_x$ where R is hydrocarbyl, preferably $C_1$–$C_{10}$ alkyl, and x is at least 3, mercaptans wherein R is $C_1$–$C_{10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

The molybdenum compounds used to prepare the molybdenum complexes used in the compositions of this invention are acidic molybdenum compounds or salts of acidic molybdenum compounds. By acidic is meant that the molybdenum compounds will react with a basic nitrogen atom of, e.g., an alkenyl succinimide in which the basicity of the basic nitrogen compound can be determined by ASTM test D664 or the D2896 titration procedure. Typically, these molybdenum compounds are hexavalent and are represented by the following compositions: molybdic oxide, molybdic acid, ammonium molybdate, sodium molybdate, potassium molybdates and other alkaline metal molybdates and other molybdenum salts such as hydrogen salts, e.g., hydrogen sodium molybdate, $MoOCl_4$, $MoO_2Br_2$, $Mo_2O_3Cl_6$, molybdenum trioxide or similar acidic molybdenum compounds. Preferred acidic molybdenum compounds are molybdic oxide, molybdic acid, ammonium molybdate, and alkali metal molybdates. Particularly preferred is molybdic oxide.

In a particularly preferred embodiment, low color intensity molybdenum/nitrogen-containing complexes used in this invention are prepared from a mixture of the molybdenum compound and a polar promoter with a basic nitrogen-containing compound, e.g., an alkenyl succinimide, with or without diluent. The diluent is used, if necessary, to provide a suitable viscosity for easy stirring. Typical diluents are lubricating oil and liquid compounds containing only carbon and hydrogen. If desired, ammonium hydroxide may also be added to the reaction mixture to provide a solution of ammonium molybdate. In this reaction, a basic nitrogen-containing compound, neutral oil, and water are charged to the reactor. The reactor is agitated and heated at a temperature less than or equal to about 120° C., preferably from about 70° C. to about 90° C. Molybdic oxide is then charged to the reactor and the temperature is maintained at a temperature less than or equal to about 120° C., preferably at about 70° C. to about 90° C., until the molybdenum is sufficiently reacted. The reaction time for this step is typically in the range of from about 2 to about 30 hours and preferably from about 2 to about 10 hours.

Typically excess water is removed from the reaction mixture. Removal methods include but are not limited to vacuum distillation or nitrogen stripping while preferably maintaining the temperature of the reactor at a temperature less than or equal to about 120° C. and more preferably between about 70° C. to about 90° C. The temperature during the stripping process is preferably held at a temperature less than or equal to about 120° C. to maintain the low color intensity of the molybdenum-containing composition. However, darker molybdenum/nitrogen-containing compositions are likewise useful in this invention. Stripping is ordinarily carried out under reduced pressure. The pressure may be reduced incrementally to avoid problems with foaming. After the desired pressure is reached, the stripping step is typically carried out for a period of about 0.5 to about 5 hours and preferably from about 0.5 to about 2 hours.

Optionally, the reaction mixture may be further reacted with a sulfur source as defined above, at a suitable pressure and temperature that preferably does not exceed 120° C. The sulfurization step is typically carried out for a period of from about 0.5 to about 5 hours and preferably from about 0.5 to about 2 hours. In some cases, removal of the polar promoter from the reaction mixture may be desirable prior to completion of reaction with the sulfur source.

In the reaction mixture, the ratio of molybdenum compound to basic nitrogen-containing compound is not critical; however, as the amount of molybdenum with respect to basic nitrogen increases, the filtration of the product becomes more difficult. Since the molybdenum component probably oligomerizes, it is advantageous to add as much molybdenum as can easily be maintained in the composition. Usually, the reaction mixture will have charged to it from 0.01 to 2.00 atoms of molybdenum per basic nitrogen atom. Preferably from 0.4 to 1.0, and most preferably from 0.4 to 0.7, atoms of molybdenum per atom of basic nitrogen is added to the reaction mixture.

When employed, the sulfur source is usually charged to the reaction mixture in such a ratio to provide up to 1 atom of sulfur per atom of molybdenum. A preferred ratio is 0.1 atom of sulfur per atom of molybdenum.

The polar promoter, which is preferably water, is ordinarily present in the ratio of 0.5 to 25 moles of promoter per mole of molybdenum. Preferably from 1.0 to 4 moles of the promoter is present per mole of molybdenum.

The basic nitrogen containing compound used to prepare the molybdenum complexes described herein are disclosed in numerous references and are well known in the art. The basic nitrogen compound used to prepare the molybdenum/sulfur compositions must contain basic nitrogen as measured by ASTM D664 test or D2896. It is preferably oil-soluble. The basic nitrogen compound is selected from the group consisting of succinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof. These basic nitrogen-containing compounds are described below (keeping in mind the reservation that each must have at least one basic nitrogen). Any of the nitrogen-containing compositions may be post-treated with, e.g., boron, using procedures well known in the art so long as the compositions continue to contain basic nitrogen. These post-treatments are particularly applicable to succinimides and Mannich base compositions.

The succinimides and polysuccinimides that can be used to prepare the molybdenum/nitrogen-containing complexes described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product, however, is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, tetraethylene pentamine, and higher molecular weight polyethylene amines. Particularly preferred are those succinimides prepared from polyisobutenyl succinic anhydride of 70 to 128 carbon atoms and tetraethylene pentamine or higher molecular weight polyethylene amines or mixtures of polyethylene amines such that the average molecular weight of the mixture is about 205 Daltons thereof.

Also included within the term "succinimide" are the cooligomers of a hydrocarbyl succinic acid or anhydride and a polysecondary amine containing at least one tertiary amino nitrogen in addition to two or more secondary amino groups. Ordinarily, this composition has between 1,500 and 50,000 average molecular weight. A typical compound would be that prepared by reacting polyisobutenyl succinic anhydride and ethylene dipiperazine.

Carboxylic acid amide compounds are also suitable starting materials for preparing the molybdenum or molybdenum/nitrogen-containing complexes used in this invention. Typical of such compounds are those disclosed in U.S. Pat. No. 3,405,064, the disclosure of which is hereby incorporated by reference. These compounds are ordinarily prepared by reacting a carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as an ethylene amine, to give a mono or polycarboxylic acid amide. Preferred are those amides prepared from (1) a carboxylic acid of the formula $R^2COOH$, where $R^2$ is $C_{12-20}$ alkyl or a mixture of this acid with a polyisobutenyl carboxylic acid in which the polyisobutenyl group contains from 72 to 128 carbon atoms and (2) an ethylene amine, especially triethylene tetramine or tetraethylene pentamine or mixtures thereof.

Another class of compounds that are useful in this invention are hydrocarbyl monoamines and hydrocarbyl polyamines, preferably of the type disclosed in U.S. Pat. No. 3,574,576, the disclosure of which is hereby incorporated by reference. The hydrocarbyl group, which is preferably alkyl, or olefinic having one or two sites of unsaturation, usually contains from 9 to 350, preferably from 20 to 200 carbon atoms. Particularly preferred hydrocarbyl polyamines are those which are derived, e.g., by reacting polyisobutenyl chloride and a polyalkylene polyamine, such as an ethylene amine, e.g., ethylene diamine, diethylene triamine, tetraethylene pentamine, 2-aminoethylpiperazine, 1,3-propylene diamine, 1,2-propylenediamine, and the like.

Another class of compounds useful for supplying basic nitrogen is the class of Mannich base compounds. These compounds are prepared from a phenol or $C_{9-200}$ alkylphenol, an aldehyde, such as formaldehyde or formaldehyde precursor such as paraformaldehyde, and an amine compound. The amine may be a mono or polyamine and typical compounds are prepared from an alkylamine, such as methylamine or an ethylene amine, such as, diethylene triamine, or tetraethylene pentamine, and the like. The phenolic material may be sulfurized and preferably is dodecylphenol or a $C_{80-100}$ alkylphenol. Typical Mannich bases that can be used in this invention are disclosed in U.S. Pat. Nos. 4,157,309 and 3,649,229; 3,368,972; and 3,539,663, the disclosures of which are hereby incorporated by reference. The last referenced patent discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of 2 to 6 carbon atoms and n is 1–10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the compound.

Another class of compounds useful for preparing the molybdenum/nitrogen-containing complexes including sulfurized versions thereof for use in this invention is the class of phosphoramides and phosphonamides such as those disclosed in U.S. Pat. Nos. 3,909,430 and 3,968,157, the disclosures of which are hereby incorporated by reference. These compounds may be prepared by forming a phosphorus compound having at least one P-N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoro amides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylamine, alkyldiamine, alkylpolyamine, or an alkyleneamine, such as ethylene diamine, diethylenetriamine, triethylenetetramine, tetraethylenepentamine, and the like.

Another class of nitrogen-containing compounds useful in preparing molybdenum/nitrogen-containing complexes including sulfurized versions thereof for use in this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes that introduce a reactive site or sites that usually has at least one oxygen atom on the polymer.

The polymer is then contacted with a nitrogen-containing source to introduce nitrogen-containing functional groups on the polymer backbone. Commonly used nitrogen sources include any basic nitrogen compound especially those nitrogen-containing compounds and compositions described herein. Preferred nitrogen sources are alkylene amines, such as ethylene amines, alkyl amines, and Mannich bases.

Preferred basic nitrogen compounds for use in this invention are succinimides, carboxylic acid amides, and Mannich bases. The preferred succinimide is prepared from a polyalkylene amine or mixtures thereof reacted with a polyisobutenyl succinic anhydride derived from the reaction of polyisobutylene with maleic anhydride as described in Harrison, et al., U.S. Pat. No. 6,156,850.

The following examples illustrate procedures for the synthesis of preferred low color intensity molybdenum/nitrogen-containing complexes followed by the darker, high color intensity molybdenum/nitrogen-containing complexes, both used in the compositions and methods of this invention.

EXAMPLE A1

250 grams of a bissuccinimide, prepared from a polyisobutenyl (1000 MW) succinic anhydride (PIBSA) and a mixture of polyethylene polyamine oligomers available as E-100 polyethyleneamine from Huntsman Chemical Company at a molar ratio of amine to PIBSA of 0.5 to 1, and 162.5 grams of neutral oil are charged to a glass reactor equipped with a temperature controller, mechanical stirrer, and water cooled condenser. The mixture is heated to a temperature of 70° C. While at reaction temperature, 26.6 grams of molybdenum oxide and 45.8 grams of water are charged to the reactor. The reactor is then held at a reaction temperature of 70° C. for 28 hours. Upon completion of the molybdation reaction, water is removed by distillation that is carried out at temperature 99° C. and a pressure of 25 millimeters of mercury (absolute) or less for approximately 30 minutes. The product contains 4.01% by weight of molybdenum and 1.98% by weight of nitrogen.

EXAMPLE A2

384.4 grams of bissuccinimide as prepared in Example A1 and 249.0 grams of neutral oil are charged to a glass reactor equipped with a temperature controller, mechanical stirrer, and water cooled condenser. The mixture is heated to molybdation reaction temperature 70° C. While at reaction temperature, 40.9 grams of molybdenum oxide and 70.4 grams of water are charged to the reactor. The reactor is then held at reaction temperature 70° C. for 18 hours. Upon completion of the molybdation reaction, water is removed by distillation that is carried out at temperature 99° C. and a pressure of 25 millimeters of mercury (absolute) or less for approximately 30 minutes. At a later time, an 18.7 gram sample of this product is charged to a 250 mL round-bottomed flask. 0.007 grams of sulfur are also charged to the flask. The reaction mixture is then heated to a sulfurization temperature of 80° C. The sulfurization reaction is carried out for 0.5 hours. The product contains 2.03% by weight of nitrogen and 3.83% by weight of molybdenum.

EXAMPLE A3

299.0 grams of a monosuccinimide, prepared from a polyisobutenyl (1000 MW) succinic anhydride (PIBSA) and a mixture of diethylene triamine (DETA) and E-100 polyethyleneamine at a molar ratio of amine to PIBSA of 0.65 to 1, and 232.1 grams of neutral oil are charged to a glass reactor equipped with a temperature controller, mechanical stirrer, and water cooled condenser. The mixture is heated to a molybdation reaction temperature of 70° C. While at reaction temperature, 34.3 grams of molybdenum oxide and 58.9 grams of water are charged to the reactor. The reactor is then held at reaction temperature 70° C. for 21 hours. Upon completion of the molybdation reaction, water is removed by distillation that is carried out at temperature 99° C. and a pressure of 25 millimeters of mercury (absolute) or less for approximately 30 minutes. The product contains 1.92% by weight of nitrogen and 4.08% by weight molybdenum.

EXAMPLE A4

1353.2 grams of monosuccinimide as prepared in Example A3 and 1057.0 grams of neutral oil are charged to a glass reactor equipped with a temperature controller, mechanical stirrer, and water cooled condenser. The mixture is heated to molybdation reaction temperature 90° C. While at reaction temperature, 155.1 grams of molybdenum oxide and 266.8 grams of water are charged to the reactor. The reactor is then held at reaction temperature 90° C. for 7 hours. Upon completion of the molybdation reaction, water is removed by distillation that is carried out at temperature 99° C. and a pressure of 25 millimeters of mercury (absolute) or less for approximately 30 minutes. The reaction mixture is then adjusted to the sulfurization temperature 80° C. 0.80 grams of sulfur are charged to the reactor. The sulfurization reaction is carried out for 0.5 hours. 2585 grams of product are produced comprising 1.97% by weight nitrogen and 4.05% by weight molybdenum.

EXAMPLE A5

26,659.0 grams of monosuccinimide as prepared in Example A3 and 20,827.0 grams of neutral oil are charged to a glass reactor equipped with a temperature controller, mechanical stirrer, and water cooled condenser. The mixture is heated to molybdation reaction temperature 90° C. While at reaction temperature, 3056.0 grams of molybdenum oxide and 5256.0 grams of water are charged to the reactor. The reactor is then held at reaction temperature 90° C. for 7 hours. Upon completion of the molybdation reaction, water is removed by distillation that is carried out at temperature 99° C. and a pressure of 25 millimeters of mercury (absolute) or less for approximately 30 minutes. The reaction mixture is then adjusted to the sulfurization temperature 80° C. 15.8 grams of sulfur are charged to the reactor. The sulfurization reaction is carried out for 0.5 hours. The product contains 1.90% by weight nitrogen, 4.05% by weight molybdenum and 0.26% by sulfur.

EXAMPLE A6

321.4 grams of monosuccinimide as prepared in Example A3 and 51.0 grams of neutral oil are charged to a glass reactor equipped with a temperature controller, mechanical stirrer, and water cooled condenser. The mixture is heated to molybdation reaction temperature 90° C. While at reaction temperature, 24.0 grams of molybdenum oxide and 41.2 grams of water are charged to the reactor. The reactor is then held at reaction temperature 90° C. for 7 hours. Upon completion of the molybdation reaction, water is removed by distillation that is carried out at temperature 99° C. and a pressure of 25 millimeters of mercury (absolute) or less for approximately 30 minutes. The reaction mixture is then adjusted to the sulfurization temperature 90° C. 0.17 grams of sulfur are charged to the reactor. The sulfurization reaction is carried out for 0.5 hours. The product contains 3.15% by weight nitrogen, 4.06% by weight molybdenum, and 0.21% by weight sulfur.

EXAMPLE A7

426.9 grams of monosuccinimide as prepared in Example A3 and 333.2 grams of neutral oil are charged to a glass reactor equipped with a temperature controller, mechanical stirrer, and water cooled condenser. The mixture is heated to molybdation reaction temperature 80° C. While at reaction temperature, 49.0 grams of molybdenum oxide and 42.1 grams of water are charged to the reactor. The reactor is then held at reaction temperature 80° C. for 4 hours. Upon completion of the molybdation reaction, water is removed by distillation that is carried out at temperature 99° C. and a pressure of 25 millimeters of mercury (absolute) or less for approximately 30 minutes. The product contains 2.00% by weight nitrogen and 4.03% by weight molybdenum.

EXAMPLE A8

399.6 grams of monosuccinimide as prepared in Example A3 and 311.9 grams of neutral oil are charged to a glass reactor equipped with a temperature controller, mechanical stirrer, and water cooled condenser. The mixture is heated to molybdation reaction temperature 80° C. While at reaction temperature, 45.8 grams of molybdenum oxide and 19.7 grams of water are charged to the reactor. The reactor is then held at reaction temperature 80° C. for 4 hours. Upon completion of the molybdation reaction, water is removed by distillation that is carried out at temperature 99° C. and a pressure of 25 millimeters of mercury (absolute) or less for approximately 30 minutes. The product contains 4.04% by weight molybdenum.

EXAMPLE A9

407.1 grams of monosuccinimide as prepared in Example A3 and 317.8 grams of neutral oil are charged to a glass reactor equipped with a temperature controller, mechanical stirrer, and water cooled condenser. The mixture is heated to molybdation reaction temperature 80° C. While at reaction temperature, 78.1 grams of molybdenum oxide and 67.1 grams of water are charged to the reactor. The reactor is then held at reaction temperature 80° C. for 8 hours. Upon completion of the molybdation reaction, water is removed by distillation that is carried out at temperature 99° C. and a pressure of 25 millimeters of mercury (absolute) or less for approximately 30 minutes. The product contains 1.84% by weight nitrogen and 6.45% by weight molybdenum.

EXAMPLE A10

390.0 grams of monosuccinimide as prepared in Example A3 and 304.4 grams of neutral oil are charged to a glass reactor equipped with a temperature controller, mechanical stirrer, and water cooled condenser. The mixture is heated to molybdation reaction temperature 80° C. While at reaction temperature, 88.2 grams of molybdenum oxide and 75.8 grams of water are charged to the reactor. The reactor is then held at reaction temperature 80° C. for 22 hours. Upon completion of the molybdation reaction, water is removed by distillation that is carried out at temperature 99° C. and a pressure of 25 millimeters of mercury (absolute) or less for approximately 30 minutes. The product contains 1.80% by weight nitrogen and 7.55% weight molybdenum.

EXAMPLE A11

10,864.0 grams of monosuccinimide as prepared in Example A3 and 5292.0 grams of neutral oil are charged to a stainless steel reactor equipped with a temperature controller, mechanical stirrer, and water cooled condenser. The mixture is heated to molybdation reaction temperature 80° C. While at reaction temperature, 1602.0 grams of molybdenum oxide and 689.0 grams of water are charged to the reactor. The reactor is then held at reaction temperature 80° C. for 7.8 hours. Upon completion of the molybdation reaction, water is removed by distillation that is carried out at temperature 99° C. and a pressure of 25 millimeters of mercury (absolute) or less for approximately 30 minutes. The reaction mixture is then adjusted to the sulfurization temperature 80° C. 5.3 grams of sulfur are charged to the reactor. The sulfurization reaction is carried out for 0.5 hours. The product contains 1.59% by weight nitrogen, 5.73% by weight molybdenum, and 0.29% by weight sulfur.

EXAMPLE A12

This example illustrates a molybdation reaction wherein the basic nitrogen reactant is a carboxylic acid amide.

A mixture of 201 grams of a carboxylic acid amide made from isostearic acid and tetraethylene pentamine, 12.9 grams of molybdic oxide, and 22.4 grams of water in toluene is heated at reflux (about 91–101° C.) for 1.5 hours. The flask is fitted with a Dean-Stark trap and a total of 16 grams of water is recovered in 0.5 hours. After filtration using diatomaceous earth filter aid, the solvent is stripped under vacuum (50 mmHg absolute) below 100° C., and 131 grams of a green product is isolated. On standing at ambient conditions, the product solidifies into a waxy material.

EXAMPLE A13

417.9 grams of monosuccinimide as prepared in Example A3 and 326.2 grams of neutral oil are charged to a glass reactor equipped with a temperature controller, mechanical stirrer, and water cooled condenser. The mixture is heated to molybdation reaction temperature 80° C. While at reaction temperature, 47.9 grams of molybdenum oxide and 82.4 grams of water are charged to the reactor. The reactor is then held at reaction temperature 80° C. for 4.0 hours. Upon completion of the molybdation reaction, water is removed by distillation that is carried out at temperature 99° C. and a pressure of 25 millimeters of mercury (absolute) or less for approximately 30 minutes. 798 grams of product are produced comprising 2.01% by weight nitrogen and 4.00% by weight molybdenum.

EXAMPLE A14

272.8 grams of monosuccinimide as prepared in Example A3 and 260.5 grams of neutral oil are charged to a glass reactor equipped with a temperature controller, mechanical stirrer, and water cooled condenser. The mixture is heated to molybdation reaction temperature 80° C. While at reaction temperature, 49.1 grams of molybdenum oxide and zero grams of water are charged to the reactor. The reactor is then held at reaction temperature 80° C. for 7.25 hours. A large amount of molybdenum oxide is unreacted.

EXAMPLE A15

9060.0 grams of monosuccinimide as prepared in Example A3 and 7071.0 grams of neutral oil are charged to a stainless steel reactor equipped with a temperature controller, mechanical stirrer, and water cooled condenser. The mixture is heated to molybdation reaction temperature 80° C. While at reaction temperature, 1737.0 grams of molybdenum oxide and 747.0 grams of water are charged to the reactor. The reactor is then held at reaction temperature 80° C. for 7.4 hours. Upon completion of the molybdation reaction, water is removed by distillation that is carried out at temperature 99° C. and a pressure of 25 millimeters of mercury (absolute) or less for approximately 1 hour. The reaction mixture is then adjusted to the sulfurization temperature 84° C. 5.6 grams of sulfur are charged to the reactor. The sulfurization reaction is carried out for 0.5 hours. Product is produced comprising 6.4% by weight molybdenum and 0.29% by weight sulfur.

EXAMPLE A16

1043.7 grams of monosuccinimide as prepared in Example A3 and 810.0 grams of neutral oil are charged to a glass reactor equipped with a temperature controller, mechanical stirrer, and water cooled condenser. The mixture is heated to molybdation reaction temperature 75° C. While at reaction temperature, 119.7 grams of molybdenum oxide and 206.0 grams of water are charged to the reactor. The reactor is then held at reaction temperature 90° C. for 7.0 hours. Upon completion of the molybdation reaction, water is removed by distillation that is carried out at temperature 99° C. and a pressure of 20 millimeters of mercury (absolute) or less for approximately 1 hour. Product is filtered through a Celite pressure filter. Product is produced comprising 4.07% by weight molybdenum.

EXAMPLE A17

9060.0 grams of monosuccinimide as prepared in Example A3 and 7071.0 grams of neutral oil are charged to a stainless steel reactor equipped with a temperature controller, mechanical stirrer, and water cooled condenser. The mixture is heated to molybdation reaction temperature 80° C. While at reaction temperature, 1737.0 grams of molybdenum oxide and 747.0 grams of water are charged to the reactor. The reactor is then held at reaction temperature 80° C. for 6.25 hours. Upon completion of the molybdation reaction, water is removed by distillation that is carried out at temperature under 120° C. and a reduced pressure for approximately 1 hour.

EXAMPLE A18

A darker color intensity moloybdenum/nitrogen compound is prepared by carrying out a higher temperature (greater than 120° C.) during the molybdation reaction, stripping and/or sulfurization steps. This example employs a 1-L, three necked round bottom glass flask, fitted with a mechanical stirrer, a heating mantle, temperature probe for controlling and measuring the temperature and a water cooled condenser. To this reactor, 296.3 grams of monosuccinimide dispersant (950 MW, 2.07% N), 25.2 grams of molybdic oxide, 43 grams of water and 135 grams of a neutral oil are added. The mixture is heated while stirring at reflux (about 100° C.) for about 2 hours. The flask was fitted with a Dean-Stark trap and the reaction mixture is heated to 170° C. for 2 hours, recovering about 40 grams of water. The product is filtered and product is produced comprising 6.0% molybdenum by weight and 0.7% sulfur by weight attributable to the base oil. Elemental sulfur is added to give a charge mole ration S/Mo of ½ at a reaction temperature of 170° C. for 4 hours, after which the solvent is stripped. The resulting product comprises 6.0% molybdenum by weight, 2.6% sulfur by weight and nitrogen content of 1.9% by weight.

The Phosphorus-containing Compound

Preferably, the oil-soluble, phosphorus-containing, anti-wear compound employed in the compositions and methods of this invention is selected from the group consisting of metal dithiophosphates, phosphorus esters (including phosphates, phosphonates, phosphinates, phosphinc oxides, phosphites, phosphonites, phosphinites, phosphines and the like), amine phosphates and amine phosphinates, sulfur-containing phosphorus esters including phosphoro monothionate and phosphoro dithionates, phosphoramides, phosphonamides and the like; all of which are well known in the art. More preferably, the phosphorus-containing compound is a metal dithiophosphate and, even more preferably, a zinc dithiophosphate. Most preferably, the phosphorous containing compound is a zinc dialkyl dithiophosphatc wherein the alkyl groups are independently selected form $C_3$ to C13, branched or straight chain carbon groups including mixtures thereof Even more preferable, the phosphorous containing compound is zinc(II) bis(O,O'-di-(2-butyl/4-methyl-2-pentyl)dithiophosphate.

The metal dithiophosphates are characterized by formula I:

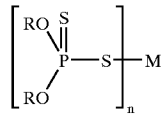

I wherein each R is independently a hydrocarbyl group containing from 3 to about 13 carbon atoms, M is a metal, and n is an integer equal to the valence of M.

The hydrocarbyl groups, R, in the dithiophosphate (or as described elsewhere in this application) can be a $C_3$ to $C_{13}$ alkyl, $C_3$ to $C_{13}$ cycloalkyl, $C_7$ to $C_{13}$ aralkyl or $C_7$ to $C_{13}$ alkaryl groups, or a substantially hydrocarbon group of similar structure. By "substantially hydrocarbon" is meant hydrocarbons that contain substituent groups such as ether, ester, nitro, or halogen which do not materially affect the hydrocarbon character of the group.

Illustrative alkyl groups include isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chlorophenyl, dichlorophenyl, and dichlorodecyl.

In another embodiment, at least one R group is an isopropyl or secondary butyl group. In yet another embodiment, both R groups are secondary alkyl groups.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The phosphorodithioic acids are typically prepared by the reaction of phosphorus pentasulfide with an alcohol or phenol or mixtures of alcohols and/or phenols. The reaction involves four moles of the alcohol or phenol per mole of phosphorus pentasulfide, and may be carried out within the temperature range from about 50° C. to about 200° C. Thus, the preparation of O,O-di-n-hexyl phosphorodithioic acid involves the reaction of phosphorus pentasulfide with four moles of n-hexyl alcohol at about 100° C. for about two hours. Hydrogen sulfide is liberated and the residue is the defined acid. The preparation of the metal salt of this acid may be effected by reaction with metal oxide. Simply mixing and heating these two reactants is sufficient to cause the reaction to take place and the resulting product is sufficiently pure for the purposes of this invention.

The metal dihydrocarbyl dithiophosphates that are useful in this invention include those salts containing Group I metals, Group II metals, zinc, aluminum, lead, tin, molybdenum, manganese, cobalt, and nickel or mixtures thereof. The Group II metals, zinc, aluminum, tin, iron, cobalt, lead, molybdenum, manganese, nickel and copper are among the preferred metals. Zinc and copper either alone or in combination are especially useful metals. Especially preferred is zinc, In one embodiment, the lubricant compositions of the invention contain examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, zinc oxide, strontium hydroxide, cadmium oxide, cadmium hydroxide, barium oxide, aluminum oxide, iron carbonate, copper hydroxide, lead hydroxide, tin burylate, cobalt hydroxide, nickel hydroxide, nickel carbonate, etc.

In some instances, the incorporation of certain ingredients such as small amounts of the metal acetate or acetic acid (glacial) in conjunction with the metal reactant will facilitate the reaction and result in an improved product. For example, the use of up to about 5% of zinc acetate in combination with the required amount of zinc oxide facilitates the formation of a zinc phosphorodithioate.

In one preferred embodiment, the alkyl groups, R, are derived from secondary alcohols such as isopropyl alcohol, secondary butyl alcohol, 2-pentanol, 4-methyl-2-pentanol, 2-hexanol, 3-hexanol, etc. Preferably R is derived from a mixture of secondary alcohols such as 2-butanol and 4-methyl-2-pentanol. Particularly preferred R is derived from the above mixture containing from about 65–75 weight percent 2-butanol with the remainder 4-methyl-2-pentanol.

Especially useful metal phosphorodithioates can be prepared from phosphorodithioic acids that, in turn, are prepared by the reaction of phosphorus pentasulfide with mixtures of alcohols. In addition, the use of such mixtures enables the utilization of cheaper alcohols which in themselves may not yield oil-soluble phosphorodithioic acids.

Useful mixtures of metal salts of dihydrocarbyl dithiophosphoric acid are obtained by reacting phosphorus pentasulfide with a mixture of (a) isopropyl or secondary butyl alcohol, and (b) an alcohol containing at least 5 carbon atoms wherein at least 10 mole percent, preferably 20 or 25 mole percent, of the alcohol in the mixture is isopropyl alcohol, secondary butyl alcohol or a mixture thereof.

Thus, a mixture of isopropyl and hexyl alcohols can be used to produce a very effective, oil-soluble metal phosphorodithioate. For the same reason, mixtures of phosphorodithoic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-l-hexanol; isobutanol and n-hexanol; isobutanol and isoamyl alcohol; isopropanol and 4-methyl-2-pentanol; isopropanol and sec-butyl alcohol; isopropanol and isooctyl alcohol; sec-butyl alcohol and 4-methyl-2-pentanol, etc. Particularly useful alcohol mixtures are mixtures of secondary alcohols containing at least about 20 mole percent and preferably at least 40 mole percent of isopropyl alcohol. In a preferred embodiment, at least 75 mole percent of sec-butyl alcohol is used and preferably combined with 4-methyl-2-pentanol, and most preferably further combined with a zinc metal.

Particularly preferred metal dihydrocarbyl phosphorodithioates include the zinc dithiophosphates. Patents describing the synthesis of such zinc dithio-phosphates include U.S. Pat. Nos. 2,680,123; 3,000,822; 3,151,075; 3,385,791; 4,377,527; 4,495,075 and 4,778,906. Each of these patents is incorporated herein by reference in their entirety.

The following examples illustrate the preparation of metal phosphorodithioates and resulting metal dialkyldithiophosphates prepared from mixtures of alcohols.

EXAMPLE B1

A phosphorodithioic acid is prepared by reacting a mixture of alcohols comprising 6 moles of 4-methyl-2-pentanol and 4 moles of isopropyl alcohol with phosphorus pentasulfide. The phosphorodithioic acid then is reacted with an oil slurry of zinc oxide. The amount of zinc oxide in the slurry is about 1.08 times and theoretical amount required to completely neutralize the phosphorodithioic acid. The oil solution of the zinc phosphorodithioate obtained in this manner (10% oil) contains 9.5% phosphorous, 20.0% sulfur and 10.5% zinc.

EXAMPLE B2

A phosphorodithioic acid is prepared by reacting finely powdered phosphorus pentasulfide with an alcohol mixture containing 11.53 moles (692 parts by weight) of isopropyl alcohol and 7.69 moles (1000 parts by weight) of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE B3

A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60–75° C. After all of the phosphorus pentasulfide is added, the mixture is heated and stirred for an additional hour at 70–75° C., and thereafter filtered through a filter aid.

Zinc oxide (282 parts, 6.87 moles) is charged to a reactor with 278 parts of mineral oil. The above-prepared phosphorodithioic acid (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 millimeters of mercury, the mixture is filtered twice through a filter aid, and the filtrate is the desired oil solution of the zinc salt containing 10% oil, 7.97% zinc (theory 7.40); 7.21% phosphorus (theory 7.06); and 15.64% sulfur (theory 14.57).

EXAMPLE B4

Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59–63° C. The mixture then is stirred at 45–63° C. for about 1.45 hours and filtered. The filtrate is the desired phosphorodithioic acid.

A reactor is charged with 312 parts (7.7 equivalents) of zinc oxide and 580 parts of mineral oil. While stirring at room temperature, the above-above-prepared phosphorodithioic acid (2287 parts, 6.97 equivalents) is added over a period of about 1.26 hours with an exotherm to 54° C. The mixture is heated to 78° C. and maintained at 75–85° C. for 3 hours. The reaction mixture is vacuum stripped to 100° C. at 19 millimeters of mercury. The residue is filtered through a filter aid, and the filtrate is an oil solution (19.2% oil) of the desired zinc salt containing 7.86% zinc, 7.76% phosphorus and 14.8% sulfur.

EXAMPLE B5

The general procedure of Example B4 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorus and 18.05% sulfur.

EXAMPLE B6

A phosphorodithioic acid is prepared in accordance with the general procedure of Example B4 utilizing an alcohol mixture containing 520 parts (4 moles) of isooctyl alcohol and 360 parts (6 moles) of isopropyl alcohol with 504 parts (2.27 moles) of phosphorus pentasulfide. The zinc salt is prepared by reacting an oil slurry of 116.3 parts of mineral oil and 141.5 parts (3.44 moles of zinc oxide with 950.8 parts (3.20 moles) of the above-prepared phosphorodithioic acid. The product prepared in this manner is an oil solution (10% mineral oil) of the desired zinc salt, and the oil solution counting 9.36% zinc, 8.81% phosphorus and 18.65% sulfur.

EXAMPLE B7

A mixture of 520 parts (4 moles) of isooctyl alcohol and 559.8 parts (9.33 moles) of isopropyl alcohol is prepared and heated to 60° C. at which time 672.5 parts (3.03 moles) of phosphorus pentasulfide are added in portions while 15 stirring. The reaction then is maintained at 60–65° C. for about one hour and filtered. The filtrate is the desired phosphorodithioic acid.

An oil slurry of 188.6 parts (4 moles) of zinc oxide and 144.2 parts of mineral oil is prepared, and 1145 parts of the above-prepared phosphorodithioic acid are added in portions while maintaining the mixture at about 70° C. After all of the acid is charged, the mixture is heated at 80° C. for 3 hours. The reaction mixture then is stripped of water to 110° C. The residue is filtered through a filter aid, and the filtrate is an oil solution (10% mineral oil) of the desired product containing 9.99% zinc, 19.55% sulfur and 9.33% phosphorus.

EXAMPLE B8

A phosphorodithioic acid is prepared by the general procedure of Example B4 utilizing 260 parts (2 moles) of isooctyl alcohol, 480 parts (8 moles) of isopropyl alcohol, and 504 parts (2.27 moles) of phosphorus pentasulfide. The phosphorodithioic acid (1094 parts, 3.84 moles) is added to an oil slurry containing 181 parts (4.41 moles) of zinc oxide and 135 parts of mineral oil over a period of 30 minutes. The mixture is heated to 80° C. and maintained at this temperature for 3 hours. After stripping to 100° C. and 19 millimeters of mercury, the mixture is filtered twice through a filter aid, and the filtrate is an oil solution (10% mineral oil) of the zinc salt containing 10.06% zinc, 9.04% phosphorus, and 19.2% sulfur.

EXAMPLE B9

Isopropyl alcohol (410 parts, 6.8 moles) and 590 parts (4.5 moles) 2-ethylhexyl alcohol are charged to a reactor and heated to 50° C. Phosphorus pentasulfide (541 parts, 2.4 moles) is added under a nitrogen sweep. The addition is complete in 1.5 hours at a reaction temperature of from 50–65° C. The contents are stirred for 2 hours and filtered at 55° C. to give the desired phosphorodithioic acid.

A reactor is charged with 145 parts (3.57 equivalents) of zinc oxide and 116 parts oil. Stirring is begun and added is 1000 parts (3.24 equivalents) of the above obtained phosphorodithioic acid over a 1 hour period beginning at room temperature. The addition causes an exotherm to 52° C. The contents are heated to 80° C. and maintained at this temperature for 2 hours. The contents are then vacuum stripped to 100° C. at 22 millimeters mercury. Added is 60 parts oil and the contents are filtered to give the desired product containing 12% oil, 9.5% zinc, 18.5% sulfur and 8.6% phosphorus.

EXAMPLE B10

A mixture of 2-butanol (237 parts, 77 mole) and 4-methyl-2-pentanol (98 parts, 23 mole) was charged to a reactor with 222 parts phosphorous pentasulfide at a temperature of about 75° C. and agitated for a period of about 2 hours. The reaction mixture was cooled and filtered to give the desired phosphorodithioic acid having a neutralization number of 193 (mgs. KOH/gram), a viscosity of 35.7 SSU at 100 degrees Fahrenheit, a specific gravity of 1.04 (60/60) and contained 24.0% sulfur and 11.9% phosphorous.

To the above mixture was added 87 parts by weight of zinc oxide, after which the whole was heated with agitation at about 54° C. for 4 hours until a pH of 6.7 was reached. After the water of neutralization had been removed, the oil solution contained 7.6% zinc, 15.0% sulfur and 7.2% phosphorous.

Another class of oil-soluble, phosphorus-containing, antiwear compounds is the class of phosphoramides and phosphonamides that includes thiophosphoramides and thiophosphonamides such as those disclosed in U.S. Pat. Nos. 3,909,430 and 3,968,157, the disclosures of which are hereby incorporated by reference. These compounds may be prepared by forming a phosphorus compound having at least one P-N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoro amides can be prepared by reacting an unsaturated hydrocarbon compound containing from 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylaamine, alkyldiamine, alkylpolyamine, or an alkyleneamine, such as ethylene diamine, diethylenetriamine, triethylenetetramine, tetraethylenepentamine, and the like.

Still further phosphorus-containing compounds are oil-soluble phosphates, phosphonates, phosphinates, or phosphine oxides represented by the formula II:

II

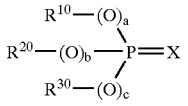

where $R^{10}$, $R^{20}$ and $R^{30}$ are independently hydrogen or hydrocarbyl groups, X is oxygen or sulfur and a, b and c are independently 0 or 1.

The phosphorus-containing compounds can be an oil-soluble phosphite, phosphonite, phosphinite or phosphine compound which can be represented by the formula III:

III

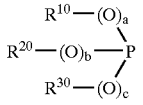

where $R^{10}$, $R^{20}$, $R^{30}$, a, b and c are as defined above.

The total number of carbon atoms in $R^{10}$, $R^{20}$ and $R^{30}$ in each of the above Formulae II and III must be sufficient to render the compound soluble in the lubricating oil used in formulating the inventive compositions. Generally, the total number of carbon atoms in $R^{10}$, $R^{20}$ and $R^{30}$ is at least about 8, and in one embodiment at least about 12, and in one embodiment at least about 16. There is no limit to the total number of carbon atoms in $R^{10}$, $R^{20}$ and $R^{30}$ that is required, but a practical upper limit is about 400 or about 500 carbon atoms. In one embodiment, $R^{10}$, $R^{20}$ and $R^{30}$ in each of the above formulae are independently hydrocarbyl groups of 1 to about 100 carbon atoms, or 1 to about 50 carbon atoms, or 1 to about 30 carbon atoms, with the proviso that the total number of carbons is at least about 8. Each $R^{10}$, $R^{20}$ and $R^{30}$ can be the same as the other, although they may be different. Examples of useful $R^{10}$, $R^{20}$ and $R^{30}$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

The phosphorus compounds represented by Formulae II and III can be prepared by reacting a phosphorus acid or anhydride with an alcohol or mixture of alcohols corresponding to $R^{10}$, $R^{20}$ and $R^{30}$ in Formulae II and III. The phosphorus acid or anhydride is generally an inorganic phosphorus reagent such as phosphorus pentoxide, phosphorus trioxide, phosphorus tetraoxide, phosphorus acid, phosphorus halide, or lower phosphorus esters, and the like. Lower phosphorus acid esters contain from 1 to about 7 carbon atoms in each ester group. The phosphorus acid ester may be a mono, di- or triphosphoric acid ester.

For a further discussion of the compounds of formulae II and III see, for example, U.S. Pat. No. 5,712,230 that is incorporated herein by reference in its entirety.

Still another class of phosphonis containing compounds is the class of oil-soluble, sulfur-containing phosphorus esters of formula IV:

IV

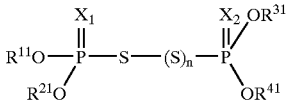

wherein $R^{11}$, $R^{21}$, $R^{31}$ and $R^{41}$ are independently hydrocarbyl groups, $X_1$ and $X^2$ are independently O or S, and n is zero to 3. In one embodiment $X^1$ and $X^2$ are each S, and n is 1. $R^{11}$, $R^{21}$, $R^{31}$ and $R^{41}$ are independently hydrocarbyl groups that are preferably free from acetylenic unsaturation and usually also free from ethylenic unsaturation. In one embodiment $R^{11}$, $R^{21}$, $R^{31}$ and $R^{41}$ independently have from about 1 to about 50 carbon atoms, and in one embodiment from about 1 to about 30 carbon atoms, and in one embodiment from about 1 to about 18 carbon atoms, and in one embodiment from about 1 to about 8 carbon atoms. Each of $R^{11}$, $R^{21}$, $R^{31}$ and $R^{41}$ can be the same as the other, although they may be different and mixtures may be used. Examples of $R^{11}$, $R^{21}$, $R^{31}$ and $R^{41}$ groups include isopropyl, butyl, n-butyl, isobutyl, amyl, 4-methyl-2-pentyl, octyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof.

Procedures for preparing the compounds of formula IV are well known in the art and are described, for example, in U.S. Pat. No. 5,712,230 that is incorporated herein by reference in its entirety.

Still another class of oil-soluble, phosphorus-containing, anti-wear additives includes the amine phosphates and thiophosphates that are known in the art and disclosed, for example, in U.S. Pat. Nos. 3,859,218; 5,585,029; and 6,040,279, all of which are incorporated herein by reference in their entirety.

The amine phosphate for use in the compositions and methods herein includes commercially available monobasic hydrocarbyl amine salts of mixed mono- and di-acid phosphates and the amine salts of di-acid phosphate. The mono- and di-acid phosphates preferably have the structural formulae VA and VB:

VA

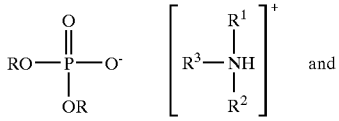

VB

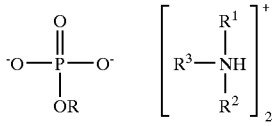

where each R is independently the same or different and are preferably $C_1$ to $C_{12}$ linear or branched chain alkyl; each of $R^1$ and $R^2$ are independently hydrogen or $C_1$ to $C_{12}$ linear or branched chain alkyl; $R^3$ is $C_4$ to $C_{12}$ linear or branched chain alkyl, or aryl-$R^4$ or $R^4$-aryl where $R^4$ is hydrogen or $C_1$ to $C_{12}$ linear or branched alkyl, and aryl is $C_6$.

The molar ratio of monoacid to diacid phosphate in the commercial amine phosphates used in this invention ranges from 3:1 to 1:3.

The mixed mono-/diacid phosphate and just the diacid phosphate can be used with the latter being the preferred. One embodiment of an acid aliphatic aromatic amine-phosphate is Vanlube RTM 692, sold commercially by the R. T. Vanderbilt Company, Inc.

The Oil of Lubricating Viscosity

The oil of lubricating viscosity used in the compositions and methods of this invention may be mineral oils or synthetic oils of viscosity suitable for use in the crankcase of an internal combustion engine. The base oils may be derived from synthetic or natural sources. Mineral oils for use as the base oil in this invention include paraffinic, naphthenlic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Formulations

The compositions of this invention comprise the following:

an oil of lubricating viscosity;

at least one oil-soluble, phosphorus-containing, anti-wear compound wherein the total phosphorus employed in the composition is no more than about 0.06 weight percent based on the total weight of the composition (preferably no more than 0.05 weight percent);

an anti-wear effective amount of a complex of a molybdenum/nitrogen containing compound; and optional additives.

Preferably the amount of atomic molybdenum employed in these compositions is about 10–5000 ppm. Stated another way, the amount of the molybdenum/nitrogen containing compound or complex is employed is from about 0.05 to 15% (preferably 0.2 to 1%) based on the total weight of the composition wherein the amount of molybdenum in said complex is sufficient to provide from about 10 to 5000 ppm molybdenum in said composition.

Preferably, the amount of oil of lubricating viscosity ranges up to about 99 weight percent of the composition based on the total weight of the composition.

These compositions are prepared merely by mixilig the appropriate amounts of each of these components until a homogenous composition is obtained.

The following additive components are examples of some of the components that can be optionally employed in the compositions of this invention. These examples of additives are provided to illustrate the present invention, but they are not intended to limit it:

(1) Metal detergents: sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

(2) Oxidation inhibitors (a) Phenol type oxidation inhibitors: 4,4'-methylene bis (2,6-di-tert-butylphenol), 4,4'-bis(2,6-di-tert-butylphenol), 4,4'-bis(2-methyl-6-tert-butylphenol), 2,2'-methylene bis(4-methyl-6-tert-butylphenol), 4,4'-butylene bis(3-methyl-6-tert-butylphenol), 4,4'-isopropylene bis(2,6-di-tert-butylphenol), 2,2'-methylene bis(4-methyl-6-nonylphenol), 2,2'-isobutylene bis(4,6-dimethylphenol), 2,2'-methylene bis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-.alpha.-dimethylamino-p-cresol, 2,6-di-tert-4-(N, N'dimethylaminomethylphenol), 4,4'-thiobis(2-methyl-6-tert-butylphenol), 2,2'-thiobis(4-methyl-6-tert-butylphenol), and bis(3-methyl-4-hydroxy-5-tert-butylbenzyl)-sulfide.

(b) Diphenyl amine type oxidation inhibitor: alkylated diphenyl amine, phenyl-.alpha.-naphthylamine, and alkylated .alpha.-naphthylamine.

(c) Other types: metal dithiocarbamate (e.g., zinc dithiocarbamate), and methylenebis (dibutyidithiocarbamate).

(3) Rust inhibitors (Anti-rust agents)

(a) Nonionic polyoxyethylene surface active agents: polyoxyethylene lauryl ether, polyoxyethylene higher alcohol ether, polyoxyethylenc nonyl phenyl ether, polyoxyethylene octyl phenyl ether, polyoxyethylene octyl stearyl ether, polyoxyethylene oleyl ether, polyoxyethylene sorbitol monostearatc, polyoxyethylene sorbitol mono-oleate, and polyethylene glycol monooleate.

(b) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(4) Demulsifiers:

addition product of alkylphenol and ethylene oxide, poloxyethylene alkyl ether, and polyoxyethylene sorbitan ester.

(5) Extreme pressure agents (EP agents):

sulfurized oils, diphenyl sulfide, methyl trichlorostearate, chlorinated naphthalene, fluoroalkylpolysiloxane, and lead naphthenate.

(6) Friction modifiers:

fatty alcohol, fatty acid, amine, borated ester (such as borated glycerol monooleate), and other esters.

(7) Multifunctional additives:

sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound.

(8) Viscosity index improvers:

polymethacrylate type polymers, ethylene-propylene copolymers, styrene-isoprene copolymners, hydrated styrene-isoprene copolymers, polyisobutylene, and dispersant type viscosity index improvers.

(9) Pour point depressants:

polymethyl methacrylate.

(10) Foam Inhibitors:

alkyl methacrylate polymers and dimethyl silicone polymers.

EXAMPLES

The invention will be further illustrated by the following examples, which set forth particularly advantageous method embodiments. While the examples are provided to illustrate the present invention, they are not intended to limit it.

As used in these examples and elsewhere in the specification, the following abbreviations have the following meanings. If not defined, the abbreviation will have its art recognized meaning.

| | |
|---|---|
| cSt = | centiStokes |
| mL = | milliliters |
| mm = | millimeters |
| MW = | molecular weight |
| ppm = | parts per million |
| s = | seconds |
| VI = | viscosity index |

In addition, all percents recited below are weight percents based on the total weight of the composition described unless indicated otherwise.

EXAMPLE 1

Four fully formulated lubricating oil compositions were prepared using the following additives:

| | |
|---|---|
| Succinimide dispersant (2300 MW) | 2.8 weight percent |
| Low overbased calcium sulfonate detergent | 5.5 millimoles |
| High overbased calcium phenate detergent | 55 millimoles |
| Zinc dithiophosphate (sufficient to provide 0.03 or 0.095 weight percent phosphorus) | |
| Friction modifier | 0.3 weight percent |
| VI improver | 9.4 weight percent |

In addition, to two of these compositions were added 0.5 weight percent of a commercially available sulfurized molybdenum/nitrogen dispersant complex prepared in accordance with Example A-18.

In each case, the balance of the composition comprised a base stock comprising a Group II base oil having a kinematic viscosity of 4.5 cSt at 100° C.) to provide for a 5W30 oil.

Each of these four compositions are recited below based on these distinctions as follows:

| | |
|---|---|
| Comparative Formulation A: | 0.03 weight percent P/no molybdenum succinimide dispersant complex |
| Comparative Formulation B: | 0.095 weight percent P/no molybdenum succinimide dispersant complex |
| Example 1A: | 0.03 weight percent P + molybdenum succinimide dispersant complex |
| Example 1B: | 0.095 weight percent P + molybdenum succinimide dispersant complex |

EXAMPLE 2

The compositions described above were tested for wear performance in a Mini-Traction Machine (MTM) bench test. The MTM is manufactured by PCS Instruments and operates in the pin-on-disk configuration in which a stationary pin (0.25 inches 8620 steel ball) is loaded against a rotating disk (32100 steel). The conditions employed a load of 25 Newtons, a speed of 500 mm/s and a temperature of 150° C.

In this bench test, wear is measured in microns of metal removed between the pin and the disk. Higher values of metal removed correspond to poor wear properties of the oil. The results of this evaluation are set forth in the table below:

| Example | Amount of Wear |
|---|---|
| Comparative Example A | 17.3 microns |
| Comparative Example B | 9.4 microns |
| Example 1A | 11.2 microns |
| Example 1B | 11.0 microns |

These results evidence that in the absence of the molybdenum nitrogen complex, significant wear occurred at a phosphorus level of approximately 0.03 weight percent and that increasing this phosphorus level by more than 3 times was required to reduce wear by approximately one-half.

Contrarily, in the presence of the molybdenum/nitrogen complex, acceptable levels of wear were achieved at 0.03 weight percent phosphorus and therefore, additional amounts of the phosphorus compound were not required.

EXAMPLE 3

Four fully formulated lubricating oil compositions were prepared using the following additives:

| | |
|---|---|
| Succinimide dispersant (2300 MW) | 2.9 weight percent |
| Borated succinimide dispersant (1300 MW) | 1.8 weight percent |
| High overbased calcium phenate detergent (250 TBN) | 55 millimoles |
| Zinc dithiophosphate (sufficient to provide 0.0475 or 0.095 weight percent phosphorus) | |
| antioxidant | 1.0 weight percent |
| VI improver | 4.5 weight percent |
| antifoam | 5 ppm |
| pour point depressant | 0.3 weight percent |

In addition, to two of these compositions were added 0.5 weight percent of a commercially available sulfurized molybdenum/nitrogen dispersant prepared in accordance with Example A-6.

In each case, the balance of the composition comprised a base stock comprising a Group II base oil having a kinematic viscosity of 4.5 cSt at 100° C. to provide for a 5W20 oil.

These compositions are recited below based on these distinctions as follows:

| | |
|---|---|
| Comparative Formulation C: | 0.048 weight percent P/no molybdenum succinimide dispersant complex |
| Comparative Formulation D: | 0.095 weight percent P/no molybdenum succinimide dispersant complex |
| Example 3A: | 0.048 weight percent P + molybdenum succinimide dispersant complex |
| Example 3B: | 0.095 weight percent P + molybdenum succinimide dispersant complex |

EXAMPLE 4

The compositions described in Example 3 above, were tested for wear performance in the Sequence IVA engine test. The Sequence IVA test evaluates a lubricant's performance in preventing camshaft lobe wear in an overhead camshaft engine. More specifically, the test measures the ability of crankcase oil to control camshaft lobe wear for spark-ignition engines equipped with an overhead valve-train and sliding can followers. This test is to simulate service for taxicab, light-delivery truck, or commuter.

The Sequence IVA test method is a 100-hour test involving 100 hourly cycles; each cycle consists of two operating modes or stages. Unleaded "Haltermnann KA24E Green" fuel is used. The test fixture is a KA24E Nissan 2.4-liter, water-cooled, fuel-injected engine, 4-cylinder in-line, overhead camshaft with two intake valves, and one exhaust valve per cylinder.

At the end of the test, each of the 12 cam lobes is measured at seven locations using a profilometer, which measures maximum depth of wear. Measurements of wear on all seven positions of each lobe are added; then all 12 lobe measurements are averaged for the wear result. This result is the primary evaluation for the test. Secondary results can include cam lobe nose wear and engine oil parameters. At 100 hours, the used oil is evaluated for: kinematic viscosity, fuel dilution, wear metals iron (Fe) and copper (Cu). Pass/fail criteria include average cam wear of 120 mm maximum. This test is currently under consideration as an ASTM standard and is currently preformed by commercial engine test laboratories in accordance with draft No. 6 having a revision date of January 2002.

In this engine test, wear is measured in microns of metal removed from the cam lobe and is reported as ACW uncorrected. Higher values of metal removed correspond to poor wear properties of the oil. The results of this evaluation are set forth in the table below:

| Example | Amount of Wear |
|---|---|
| Comparative Example C | 332.3 microns |
| Comparative Example D | 45.6 microns |
| Example 3A | 48.3 microns |
| Example 3B | 38.2 microns |

These results evidence that in the absence of the molybdenum/nitrogen complex, significant wear occurred at a phosphorus level of approximately 0.048 weight percent and that increasing this phosphorus level by about 2 times was required to reduce wear to acceptable levels.

Contrarily, in the presence of the molybdenum/nitrogen complex, acceptable levels of wear were achieved at 0.045 weight percent phosphorus and therefore, additional amounts of the phosphorus compound were not required.

From the foregoing description, various modifications and changes in the above described invention will occur to those skilled in the art. All such modifications coming within the scope of the appended claims are intended to be included therein.

What is claimed is:

1. A lubricating oil composition comprising a major amount of an oil of lubricating viscosity;

at least one oil-soluble, phosphorus-containing, anti-wear compound wherein the weight percent of total phosphorus in the composition is no more than about 0.06 weight percent based on the total weight of the composition; and an anti-wear effective amount of a molybdenum/nitrogen-containing complex wherein the nitrogen-containing compound employed in the molybdenum/nitrogen complex is selected from the group consisting of succinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof.

2. The lubricating oil composition of claim 1 wherein the total phosphorus in the composition is no more than 0.05 weight percent based on the total weight of the composition.

3. The lubricating oil composition of claim 1 wherein the oil-soluble, phosphorus-containing, anti-wear compound is selected from the group consisting of metal dithiophosphates, phosphorus esters, amine phosphates and amine phosphinates, sulfur-containing phosphorus esters, phosphoramides and phosphonamides.

4. The lubricating oil composition of claim 3 wherein said phosphorus esters are selected from the group consisting of phosphates, phosphonates, phosphinates, phosphine oxides, phosphites, phosphonites, phosphinites, and phosphines.

5. The lubricating oil composition of claim 3 wherein said sulfur-containing phosphorus esters are selected from the group consisting of phosphoro monothionate and phosphoro dithionates.

6. The lubricating oil composition of claim 3 wherein the oil-soluble, phosphorus-containing, anti-wear compound is a metal dithiophosphate.

7. The lubricating oil composition of claim 6 wherein the metal dithiophosphate is a zinc dialkyldithiophosphate.

8. The lubricating oil composition of claim 1 wherein said nitrogen-containing compound is a succinimide and the molybdenum/nitrogen-containing complex is a molybdenum succinimide.

9. The lubricating oil composition of claim 8 wherein said molybdenum succinimide is a sulfurized molybdenum succinimide.

10. The lubricating oil composition of claim 8 wherein the molybdenum succinimide is a non-sulfurized molybdenum succinimide.

11. The lubricating oil composition of claim 8 wherein the molybdenum succinimide is employed in an amount sufficient to provide from about 10 to about 5000 parts per million of atomic molybdenum in the lubricant composition.

12. A method for controlling wear during operation of an internal combustion engine which engine is lubricated with a lubricant composition comprising a major amount of an oil of lubricating viscosity and at least one phosphorus containing compound wherein the weight percent of total phosphorus in the composition is no more than about 0.06 weight percent based on the total weight of the composition wherein said method comprises combining into said composition an anti-wear effective amount of a molybdenum/nitrogen-containing complex wherein the nitrogen-containing compound employed in the molybdenum/nitrogen complex is selected from the group consisting of succinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof.

13. The method according to claim 12 wherein the total phosphorus in the composition is no more than 0.05 weight percent based on the total weight of the composition.

14. The method according to claim 12 wherein the oil-soluble, phosphorus-containing, anti-wear compound is selected from the group consisting of metal dithiophosphates, phosphorus esters, amine phosphates and amine phosphinates, sulfur-containing phosphorus esters, phosphoramides and phosphonamides.

15. The method according to claim 14 wherein said phosphorus esters are selected from the group consisting of phosphates, phosphonates, phosphinates, phosphine oxides, phosphites, phosphonites, phosphinites, and phosphines.

16. The method according to claim 14 wherein said sulfur-containing phosphorus esters are selected from the group consisting of phosphoro monothionate and phosphoro dithionates.

17. The method according to claim 14 wherein the phosphorus containing compound is a metal dithiophosphate.

18. The method according to claim 17 wherein the metal dithiophosphate is a zinc dialkyldithiophosphate.

19. The method according to claim 12 wherein said nnitrogen-containing compound is a succinimide and the molybdenum/nitrogen-containing complex is a molybdenum succinimide.

20. The method according to claim 19 wherein said molybdenum succinimide is a sulfurized molybdenum succinimide.

21. The method according to claim 19 wherein the molybdenum succinimide is a non-sulfurized molybdenum succinimide.

22. The method according to claim 19 wherein the molybdenum succinimide is employed in an amount sufficient to provide from about 10 to about 5000 parts per million of atomic molybdenum in the lubricant composition.

* * * * *